US006808447B2

(12) United States Patent
Arcobello

(10) Patent No.: US 6,808,447 B2
(45) Date of Patent: Oct. 26, 2004

(54) TOOL, IN PARTICULAR DIAMOND SECTOR FOR MACHINES FOR POLISHING SURFACES SUCH AS AGGLOMERATES, TILES OR THE LIKE

(76) Inventor: Tullio Arcobello, Via Locatelli, 88, Trescore Balneario BG (IT), I-24069

( * ) Notice: Subject to any disclaimer, the term of this patent is extended or adjusted under 35 U.S.C. 154(b) by 0 days.

(21) Appl. No.: 10/208,760

(22) Filed: Aug. 1, 2002

(65) Prior Publication Data

US 2003/0027510 A1 Feb. 6, 2003

(30) Foreign Application Priority Data

Aug. 6, 2001 (IT) ..... PC2001U0018

(51) Int. Cl.[7] ..... B24B 25/00

(52) U.S. Cl. ..... 451/540; 451/461; 451/523; 451/525

(58) Field of Search ..... 451/540, 359, 451/356, 357, 441, 461, 523, 525

(56) References Cited

U.S. PATENT DOCUMENTS 4,484,560 A * 11/1984 Tanigawa ..... 125/15
4,937,984 A * 7/1990 Taranto ..... 451/524
5,345,724 A * 9/1994 Ng, Jr. ..... 451/351
5,445,558 A * 8/1995 Hutchins ..... 451/344
5,967,886 A * 10/1999 Wuensch et al. ..... 451/356
6,099,397 A * 8/2000 Wurst ..... 451/344
6,196,911 B1 * 3/2001 Preston et al. ..... 451/548
2003/0027510 A1 * 2/2003 Arcobello ..... 451/461

* cited by examiner

*Primary Examiner*—Lee D. Wilson
(74) *Attorney, Agent, or Firm*—Young & Thompson

(57) ABSTRACT

A tool for surface smoothing machines, includes a substantially plane support, provided at one side with a coupling for fitting to a smoothing machine, and at the opposite side with a housing that protrudes relative to the plane; a housing for an abrasive member, provided on a body protruding from the support and provided with an external raised edge; a layer made of deformable material inserted into the housing containing a sector of abrasive material inserted into said housing. These features prevent the same support from coming into contact with the surface to be polished when the tool is worn, which may therefore damage the surface itself. The wedge shape is such that in each portion, the sector exhibits a rest surface that is proportional to the speed at which it moves onto the surface to be polished, so as to obtain a perfectly even wear of the entire tool.

13 Claims, 4 Drawing Sheets

Fig. 5
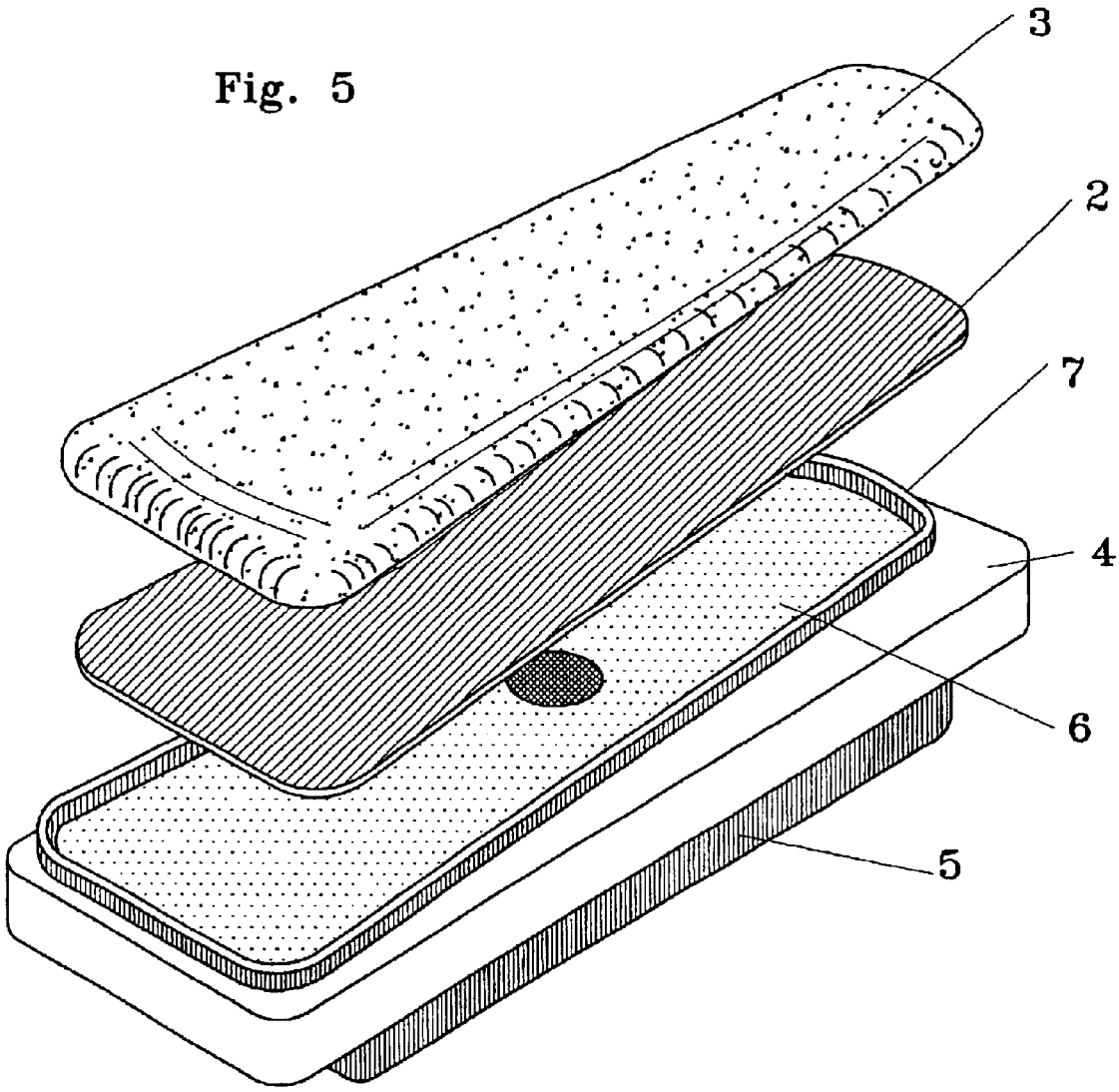
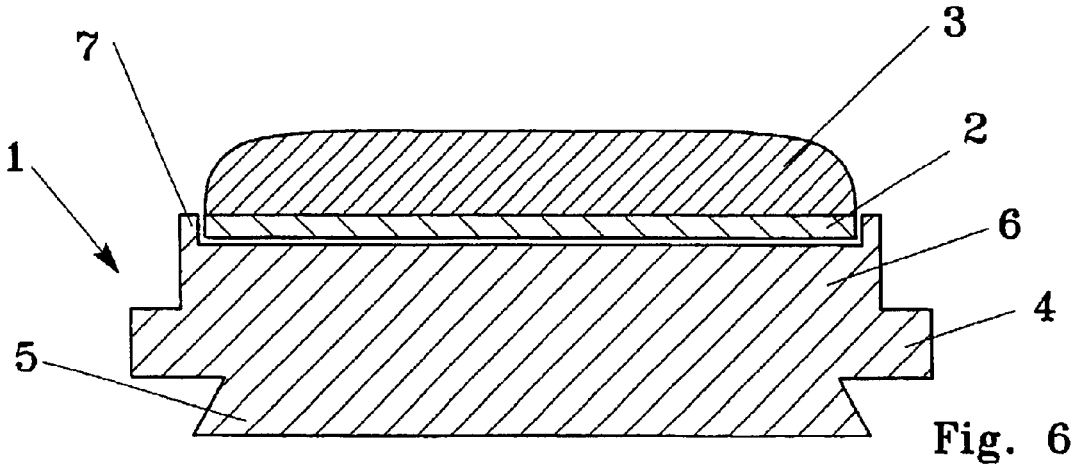
Fig. 6

TOOL, IN PARTICULAR DIAMOND SECTOR FOR MACHINES FOR POLISHING SURFACES SUCH AS AGGLOMERATES, TILES OR THE LIKE

BACKGROUND OF THE INVENTION

The present invention relates to a tool consisting of a diamond sector to be applied to machines for polishing surfaces, in particular surfaces made up of agglomerate, or tiles and the like.

The tool according to the invention includes a support provided with a coupling that allows its application to the machine, and to which an abrasive sector with wedge-shaped section is fitted, inserted into a housing protruding from the support by a certain portion, in order to prevent the same support from coming into contact with the surface to be polished when the tool is worn, which may therefore damage the surface itself. The wedge shape is such that in each portion, the sector exhibits a rest surface that is proportional to the speed at which it moves onto the surface to be polished, so as to obtain a perfectly even wear of the entire tool.

The invention can be framed in the field of equipment for finishing surfaces, and in particular it relates to equipment for laying and finishing flooring and the like.

DESCRIPTION OF THE RELATED ART

Flooring finishing machines are known, which comprise a generally disc-shaped body made to rotate by a motor, to which several tools are applied, consisting of diamond sectors that are made to rotate in contact with the floor to abrade and polish its surface.

European patent application 1.046.467 discloses a finishing machine with rotating head carrying several abrasive sectors having a segmented, resilient structure.

Each sector exhibits a rolled structure comprising a support made of a rigid and mechanically resistant material, inserted into a corresponding housing provided into the machine, at least one abrasive sector and at least one elastomer layer placed between the support and the abrasive sector, the latter having a substantially cylindrical surface defined by the several surfaces of as many protruding members consisting of an aggregate of resin and abrasive material, which has an embedded strengthening fibre. However, this solution still exhibits some shortcomings, since when the abrasive layer wears out, the relevant supports—which are mounted on a machine in an oscillating manner so as to adapt to the unevenness of the floor—sometimes tilt and scratch the surface with an edge, thereby damaging it.

In addition, known tools sometimes exhibit shortcomings due to a non-perfect adherence of the abrasive sector from the relevant support. The problems mentioned above are solved by the present invention, which discloses a tool comprising a support to be applied to the machine, an abrasive sector that is applied to said support; the support exhibits a protruding housing for said sector, so that the support edges never come into contact with the surface even if the tool tilts slightly; said housing exhibits an external raised edge intended to firmly hold the abrasive sector where, between said support and said abrasive sector, a thin rubber layer or similar slightly deformable material is provided, such as to adapt to the unevenness of the surfaces and thereby allow a perfect adherence of the same.

BRIEF DESCRIPTION OF THE DRAWINGS

FIG. 5 is an exploded axonometric view of the tool according to the invention;

FIG. 6 is a sectioned view of the tool according to the invention; and

With reference to FIGS. 1 and 2, the tool according to the invention comprises a support 1 to be applied to the machine, an intermediate layer 2 and a sector made of an abrasive material, globally indicated with reference numeral 3.

Support 1 can be made of a rigid plastic material of suitable type, such as ABS or the like, whereas sector 3 preferably consists of a resin containing abrasive particles, in particular diamond powder.

Figure 2:
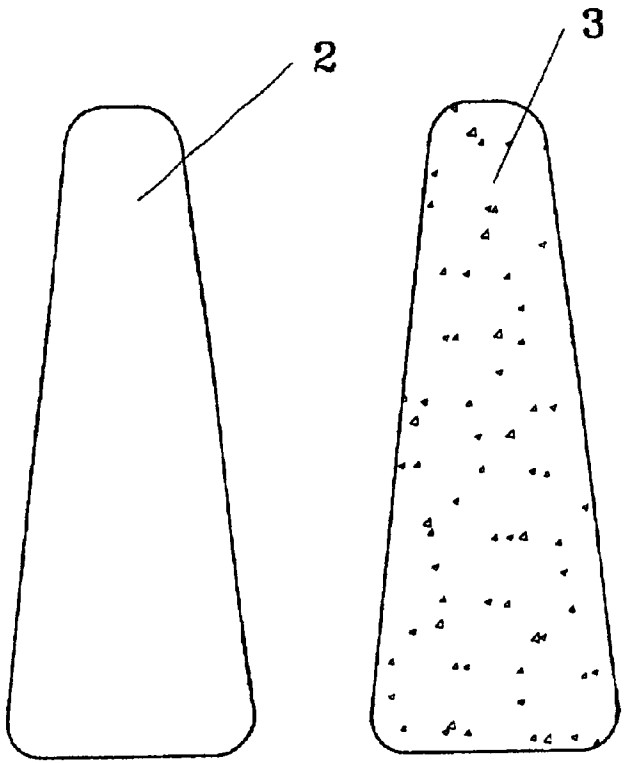
FIG. 2 shows a plan view of the abrasive sector and of the intermediate rubber layer.
Figure 1:
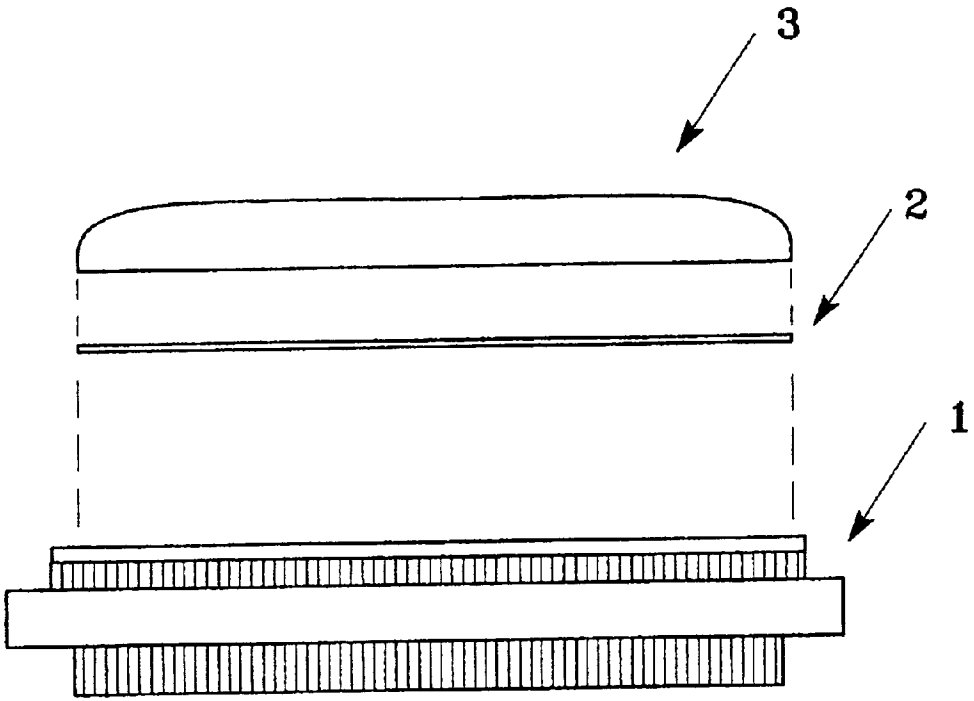
FIG. 1 shows a view of the single tool component parts.
Figure 4:
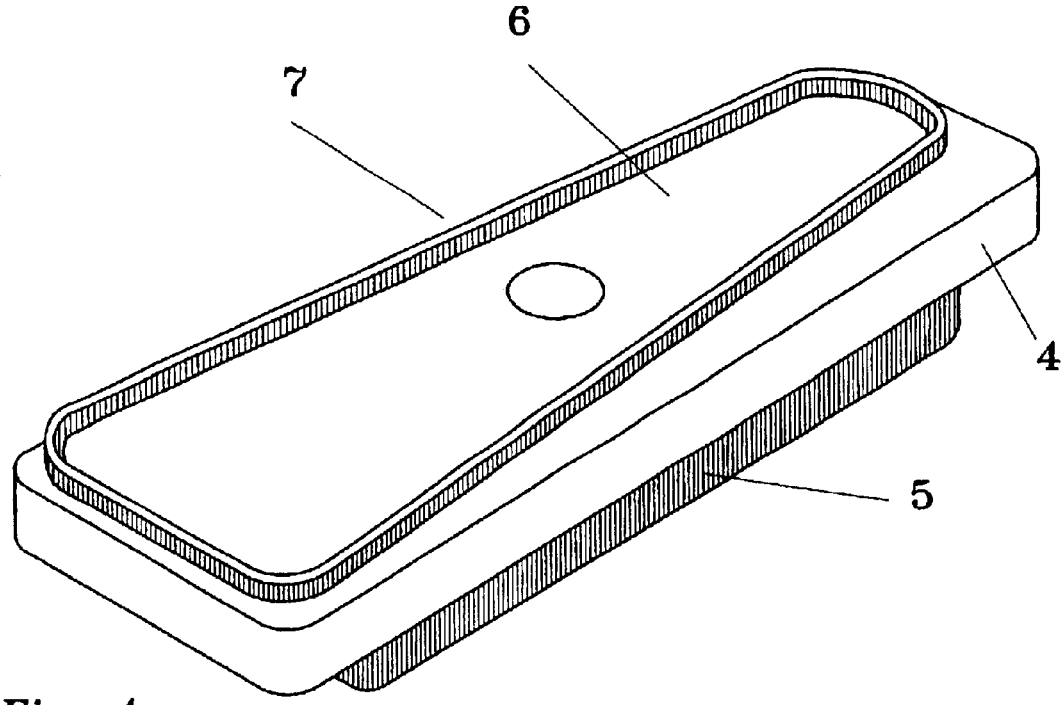
FIGS. 3 and 4 are perspective views of the tool support according to the invention, from top and from below respectively.
Figure 3:
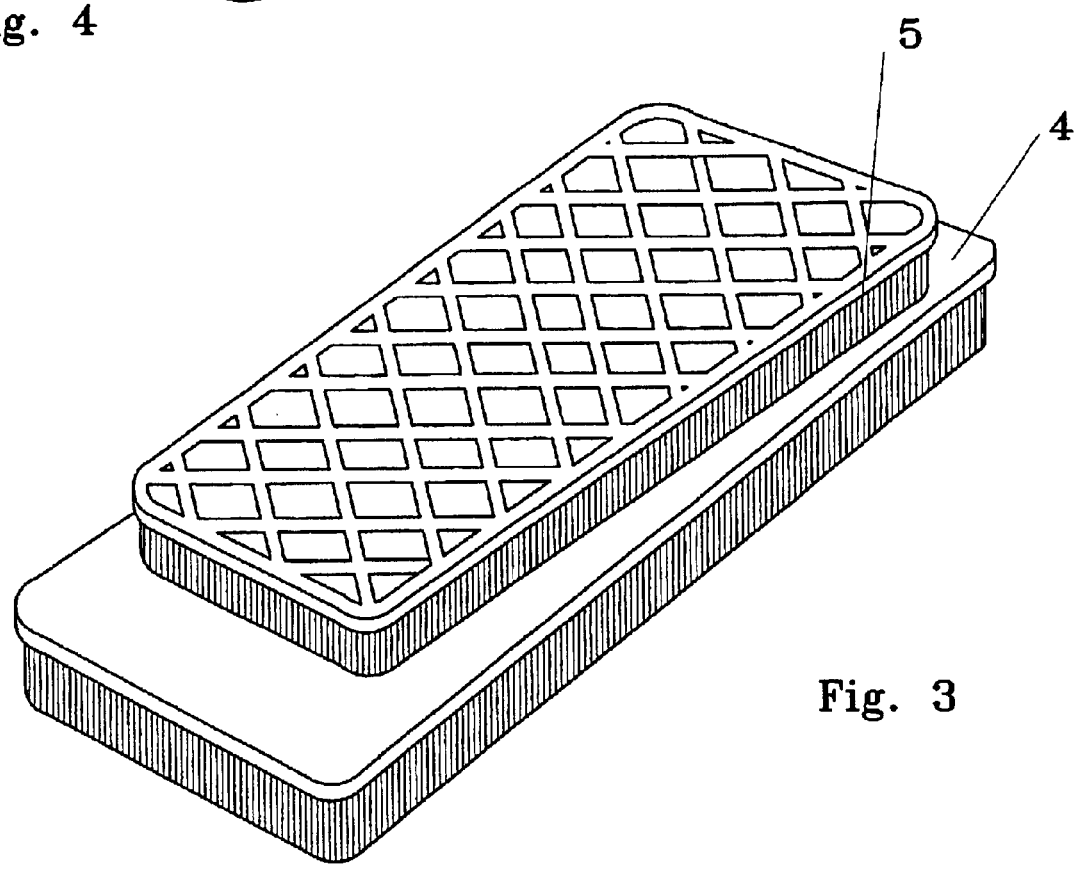

Support 1, (FIGS. 3 and 4) comprises a body 4 with a coupling 5, for example of the dovetail type, for application to the machine, and at the opposite side, a protruding portion indicated with reference numeral 6 in FIG. 3, which forms the housing where the abrasive sector 3 rests.

Housing 6 has a thickness of a few millimetres, such as to keep the abrasive sector slightly raised from the support surface.

In this way, even though the tool tilts slightly, when it is fitted to the machine to adapt to the floor undulation, body 4 always remains slightly spaced from the surface to be smoothed, without the risk of scratching and damaging it.

According to a further feature of the invention, the raised housing 6 has the same size as the intermediate layer 2 and as the abrasive sector 3, and exhibits an external protruding edge 7 which defines a frame, wherein the rubber layer 2 and the abrasive sector 3 are housed.

Layer 2, which is made of rubber or similar material, thin and sufficiently deformable, has the purpose of adapting to the surfaces in contact with the abrasive sector 3 and with the bottom of housing 6, so as to compensate for this unevenness and ensure perfect contact and thereby perfect adherence between the sector and support 1.

Figure 7:
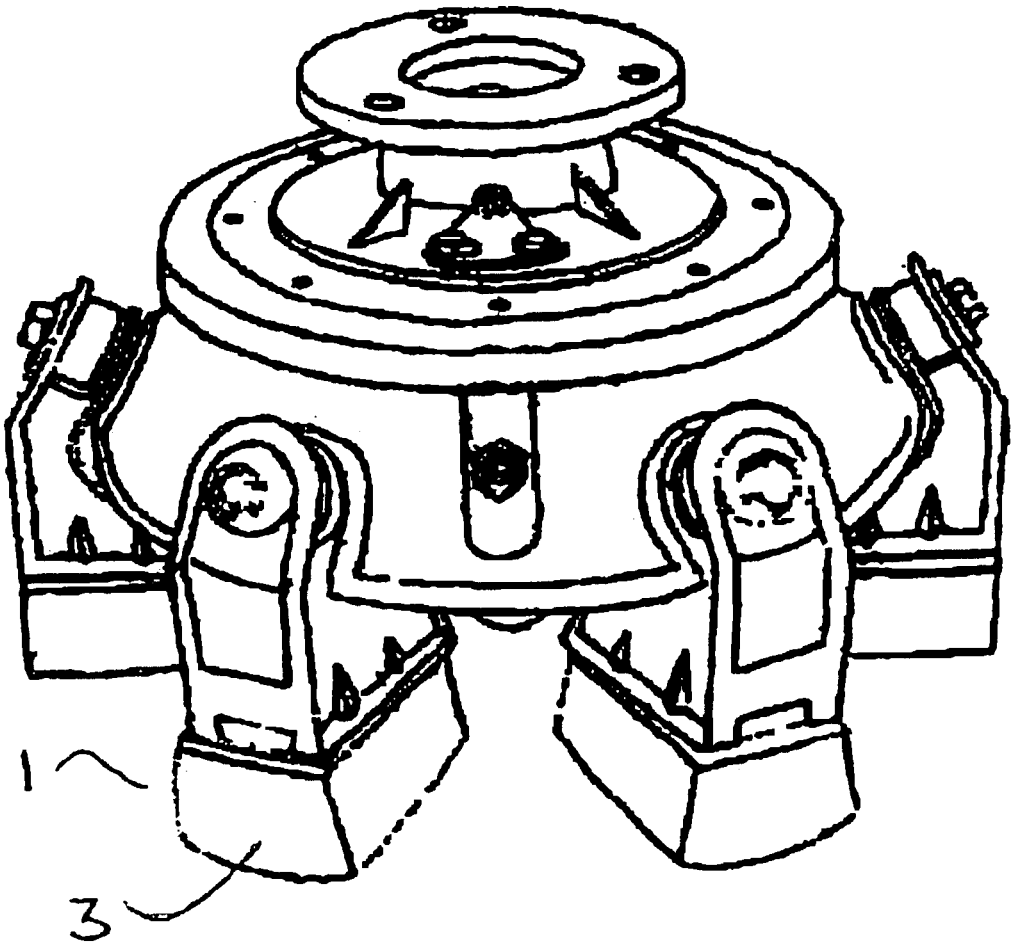
FIG. 7 shows the tool in combination with a prior art smoothing machine.

FIG. 5 shows how the various parts are arranged for assembly, whereas FIG. 6 shows a sectioned view of the tool according to the invention, when assembled. FIG. 7 shows the tool mounted to a prior-art smoothing machine.

The tool with the configuration shown exhibits considerable advantages compared to known ones.

From a plan view, the abrasive sector 3 has a slice- or wedge-shaped configuration, so that in each point of the tool along the axis, the width of the tool is proportional to the tool speed in that point along the axis.

In this way, the tool wear is even along the entire surface, which allows for a greater regularity of the results and a longer life of the tool itself.

During operation, the tool oscillates around its axis to adapt to the floor unevenness.

Thanks to the fact that housing 6 is raised compared to support 4, when the tool tilts slightly, the support does not run the risk of scratching the surface to be levelled, even if the abrasive layer 3 is worn.

In addition, the adherence of the diamond sector to housing 6 of the support is perfect, also thanks to the rubber sheet or other deformable material 2 placed in between, which, thanks to its elasticity, compensates for any unevenness or irregularities of the surfaces of housing 6 and of sector 3 to be connected.

A better adherence of the abrasive sector to the relevant support is thereby obtained, and edge 7 of housing 6 helps to hold the diamond sector in place, also in case of long use of the machine.

A tool is therefore obtained, which compared to known ones is more useful thanks to the special configuration and arrangement of the parts.

It is understood that sizes, as well as materials used, can change according to the use requirements.

What is claimed is:

1. A tool for machines for smoothing surfaces such as flooring, agglomerate surfaces, tiles, comprising:

a support;

a first face of the support including a coupling adapted for fitting onto a smoothing machine; and a sector of an abrasive material applied to a second face of said support, wherein, said abrasive sector is wedge-shaped, in plan view, said abrasive sector has a longitudinal axis, and said abrasive sector has, at any point along the axis, a width proportional to a tool sliding speed in that point along the axis, said second face of said support comprises a housing for said abrasive sector, said housing protruding relative to the second face of said support, said abrasive sector is applied to said housing so that if the tool tilts during operation, an external edge of said support does not come into contact with the surface to be smoothed.

2. The tool for surface smoothing machines according to claim 1, said housing for said abrasive sector includes a raised edge located to hold said abrasive sector.

3. A tool for surface smoothing machines, comprising:

a support with substantially planar opposite first and second faces;

a coupling for fitting to a smoothing machine protruding from the first face of the support relative to a plane of the first face;

a body protruding from the second face of the support relative to a plane of the second face;

a housing with an external raised edge provided on the body;

an abrasive member made of abrasive material contained within the housing and the external raised edge; and a layer made of deformable material inserted intermediate the housing abrasive member.

4. The tool of claim 3, wherein the abrasive material is a resin containing diamond powder.

5. The tool of claim 3, wherein the abrasive member is wedge shaped.

6. The tool of claim 5, wherein the body has, in plan view, an overall rectangular shape.

7. The tool of claim 6, wherein, in section, the coupling is of a dovetail shape.

8. The tool of claim 7, wherein the deformable material is rubber.

9. A tool for surface smoothing machines, comprising:

a support with a rectangular perimeter and substantially planar opposite first and second faces;

a dovetail coupling for fitting to a smoothing machine protruding from the first face of the support relative to a plane of the first face;

a wedge-shaped housing protruding from the second face of the support relative to a plane of the second face, the housing having an external raised edge; and an abrasive member made of abrasive material contained within the housing by the external raised edge.

10. The tool of claim 9, further comprising:

a layer made of deformable material inserted intermediate the housing abrasive member.

11. The tool of claim 10, wherein the deformable material is rubber.

12. The tool of claim 9, wherein the abrasive material is a diamond-containing resin.

13. The tool of claim 9, wherein the abrasive member is wedge shaped.

* * * * *